US007201595B1

(12) United States Patent
Morello

(10) Patent No.: US 7,201,595 B1
(45) Date of Patent: Apr. 10, 2007

(54) ELECTRICAL CONNECTOR BODY CO-MOLDED WITH CABLE AND PERIPHERAL SEALS

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/327,274

(22) Filed: Jan. 6, 2006

(51) Int. Cl.
*H01R 13/52* (2006.01)

(52) U.S. Cl. ..... 439/271; 439/289

(58) Field of Classification Search ..... 439/271, 439/272, 273, 274, 275, 276, 277, 289; 29/883
See application file for complete search history.

(56) References Cited

U.S. PATENT DOCUMENTS 6,033,261 A * 3/2000 Wakata et al. ..... 439/587
6,368,132 B1 * 4/2002 Okayasu ..... 439/273
6,527,586 B2 * 3/2003 Okamura et al. ..... 439/587
6,547,605 B2 4/2003 Daugherty et al.
6,582,242 B2 * 6/2003 Murakami et al. ..... 439/271
6,896,524 B1 5/2005 Morello et al.

* cited by examiner

*Primary Examiner*—Thanh-Tam Le
(74) *Attorney, Agent, or Firm*—David P. Wood

(57) ABSTRACT

A socket connector having a connector body co-molded with its peripheral and cable seals. In the first molding operation, a first tooling is placed into a mold and is configured so that plastic injected into the mold forms the connector body. In the second molding operation, a second tooling is placed into the mold and is configured so that elastomeric material injected into the mold passes through at least one passage of the connector body to thereby form the peripheral seal and, integrally therewith, the cable seal.

11 Claims, 5 Drawing Sheets

ELECTRICAL CONNECTOR BODY CO-MOLDED WITH CABLE AND PERIPHERAL SEALS

TECHNICAL FIELD

The present invention relates to electrical connectors, and more particularly to an electrical socket connector having a connector body which is co-molded with its cable and peripheral seals.

BACKGROUND OF THE INVENTION

A low profile socket connector having a shroud and a connector lock in which the enlargement for accommodating the connector lock has been eliminated by incorporating a lock arm in the shroud itself has been disclosed in U.S. Pat. No. 6,896,524 issued May 24, 2005, the disclosure of which is hereby incorporated herein by reference.

Referring now to FIGS. 1A through 1C, a low profile socket connector 10 will be described.

The low profile socket connector 10 has a connector body 12 having a terminal housing 14 with internally disposed terminal cavities 16 that extend through a terminal housing 14. Female electric terminals (not shown) attached to lead wires 18*a*, 18*b* are inserted into the rearward ends of the terminal cavities 16 and retained in the terminal cavities via terminal seats 16*a* in a conventional manner. Any suitable female terminals and lead wires may be used for this purpose.

The connector body 12 includes an annular shroud 20 that is integrally connected to a mid-portion of the terminal housing 14 by a perpendicular end wall 22. The shroud 20 and end wall 22 form a socket 24 for receiving a plug connector 60 that has male terminals that mate with the female terminals in terminal housing 14 when the plug connector is plugged into the socket 24. The connector body 12 has a connector lock indicated generally at 26 for retaining the plug connector in the socket 24. The connector lock 26 is incorporated into the shroud 20 of the connector body 12 so as to provide a low profile socket connector as described below.

Connector lock 26 comprises an arm or beam 30 that is formed out of a forward exterior wall portion 32 of the shroud 20 itself and a rearward exterior wall portion 34 of the shroud 20 that extends rearward of end wall 22. An arm 30 is formed by forward and rearward pairs of through-slots 36, 38, wherein the through-slots are symmetrically disposed on either side of the arm 30, and extend through the forward and rearward exterior wall portions 32 and 34. The forward pair of through-slots 36 extend through the forward portion 32 and a forward portion of the rearward portion 34 of the shroud 20, as best shown in FIG. 1A. The rearward pair of through-slots 38 extend through the aft portion of the rearward exterior wall portion 34.

Both pairs of through-slots 36 and 38 have longitudinal parts and transverse parts so that the two-pairs of through-slots 36 and 38 cooperatively form flexible straps 40 that connect arm 30 to the remainder of the exterior wall of the shroud 20, specifically, the rearward exterior wall portion 34.

The forward pair of through-slots 36 are preferably generally U-shaped so that there are second forward transverse parts that provide flexible straps 42 at the front end of the shroud 20. Flexible straps 42 provide a continuous front edge and anti-tangle feature for shroud 20 while allowing the front of arm 30 to bow outwardly to operate the connector lock as explained below. The rearward through slots 38 are generally L-shaped so that the aft end of arm 30 forms a depressible "pump handle" release lever 44 that is free of the extended rearward exterior wall portion 34 of shroud 20.

The arm 30 has a lock nib 46 that is located between the straps 40 and 42 in the longitudinal direction and extends inwardly into the socket 24. The arm 30 also has and a triangularly shaped fulcrum 48 that extends inwardly into a space behind the end wall 22 of the socket 24. The triangularly shaped fulcrum 48 slopes outwardly in the rearward direction. The end wall 22 at the inner end of the socket 24 has a window to facilitate molding lock nib 46 and triangularly shaped fulcrum 48 preferably also has a slot aligned with lock nib 46 longitudinally to further facilitate molding lock nib 46.

Connector body 12 has a triangularly shaped fulcrum support 52 that is connected to the end wall 22, which slopes inwardly in the rearward direction. The fulcrum support 52 is located beneath the fulcrum 48 with its high point substantially aligned with the high point of fulcrum 48 to facilitate depression of the release lever 44. The fulcrum support 52 may also have a slot to facilitate molding.

The low profile socket connector 10 mates with a plug connector 60 that includes a forward plug portion 62 that plugs into the socket 24 as shown in FIGS. 1B and 1C. A loose piece peripheral seal 45 is slid over the terminal housing 14 and located within the socket 24 for sealing with respect to the forward plug portion 62.

In operation, due to the flexibility of the lock arm 30 and the straps 40 and 42, the lock nib 46 snaps over a lock shoulder (not shown) of the plug connector 60 when the plug portion 62 of the plug connector 60 is plugged into socket 24. The lock nib 46 thus retains the plug portion 62 of the plug connector 60 in the socket 24. In order to disconnect the plug connector 60, the end of "pump handle" release lever 44 is depressed manually, which causes the fulcrum 48 to engage the fulcrum support 52 and bow the forward portion of lock arm 30 outwardly so that the lock nib 46 is moved out of engagement with the lock shoulder of the plug connector 60. The plug connector 60 is then pulled away from the low profile socket connector 10. Although, lock arm 30 is preferably connected to the remainder of the shroud 20 both at the front end and rearward portion of the shroud 20, the flexibility of lock arm 30 and straps 40 and 42 is sufficient to lift the lock nib 46 out of engagement with the lock shoulder of the plug connector 60.

While the exterior wall 32 of the shroud 20 is illustrated as being generally elliptical, the exterior wall can be another shape, such as round, square or rectangular. In essence, the height or profile of any shape of connector can be reduced to provide a low profile socket connector so long as the exterior wall of the shroud has a lock arm located in a portion of the exterior wall of the shroud itself.

As shown at FIGS. 1B and 1C, the rearward end 64 of the connector body 12 (opposite the socket 24 which is disposed at a forward end of the connector body) has a seal housing 66 having a seal cavity 68 into which a seal 70 is slid along a longitudinal direction (parallel to the wires 18*a*, 18*b*). A loose piece strain relief 72 is then snapped onto the seal housing 66 which serves to trap the seal 70 in the seal cavity 68 and further locates the wires 18*a*, 18*b* so as to relieve strain induced by movements of the wires exterior to the low profile socket connector 10.

What remains needed in the art is an elimination of the need for a loose parts for the strain relief, cable and peripheral seals for socket connectors.

SUMMARY OF THE INVENTION

The present invention is a socket connector having peripheral and cable seals that are sequentially co-molded with the connector body using preferably the same mold.

The socket connector according to the present invention has a connector body which includes, at a forward end thereof, a shroud defined socket in which is located a forward portion of a terminal housing, and, at rearward end thereof, a strain relief member. The strain relief member is composed of a rearward portion of the terminal housing, a strain relief, and a seal seat. The seal seat is defined by a seal seat housing characterized by a left sidewall, a right sidewall, a top wall, each of which being formed between the terminal housing and the strain relief, wherein a bottom opening opposite the top wall is provided. In this regard, the seal seat is further characterized by the terminal housing having a terminal housing wall which faces, in parallel relation, a strain relief wall of the strain relief. The strain relief is provided with strain relief cable openings aligned with the terminal cavities of the socket connector for locating electrical cables (wires) passing out from the terminal cavities. At least one passage is provided in the connector body at the rearward end thereof.

In operation, a mold is provided in which first tooling for a first molding operation and second tooling for a second molding operation is provided, the first and second molding operations constituting a co-mold process for forming the socket connector according to the present invention.

In the first molding operation of the co-mold process, the first tooling is placed into the mold, configured so that plastic injected into the mold forms the connector body (integrally inclusive of the terminal housing and strain relief member). The first tooling may remain in the mold, or a portion thereof, or all thereof may be removed from the mold.

In the second molding operation of the co-mold process, the second tooling is placed into the mold, configured so that elastomeric material injected into the mold passes through the at least one passage to thereby form the peripheral seal and, integrally therewith, the cable seal, wherein the peripheral seal is located within the socket and peripherally engirds the forward portion of the terminal housing, and wherein the cable seal is disposed within the seal seat. The second tooling and any remaining portion of the first tooling are removed from the mold.

After the co-mold process has been completed and the socket connector removed from the mold, terminals, which are located at respective ends of cables (wires), are placed into the respective terminal cavities and seated at respective terminal seats of the forward end of the terminal housing by passing through respectively aligned strain relief and seal openings into the terminal cavity, wherein the terminal cavities commence at the terminal housing wall.

Accordingly, it is an object of the present invention to provide a socket connector wherein the connector body thereof is sequentially co-molded with the peripheral and cable seals thereof.

This and additional objects, features and advantages of the present invention will become clearer from the following specification of a preferred embodiment.

DESCRIPTION OF THE PREFERRED EMBODIMENT

Figure 1A:
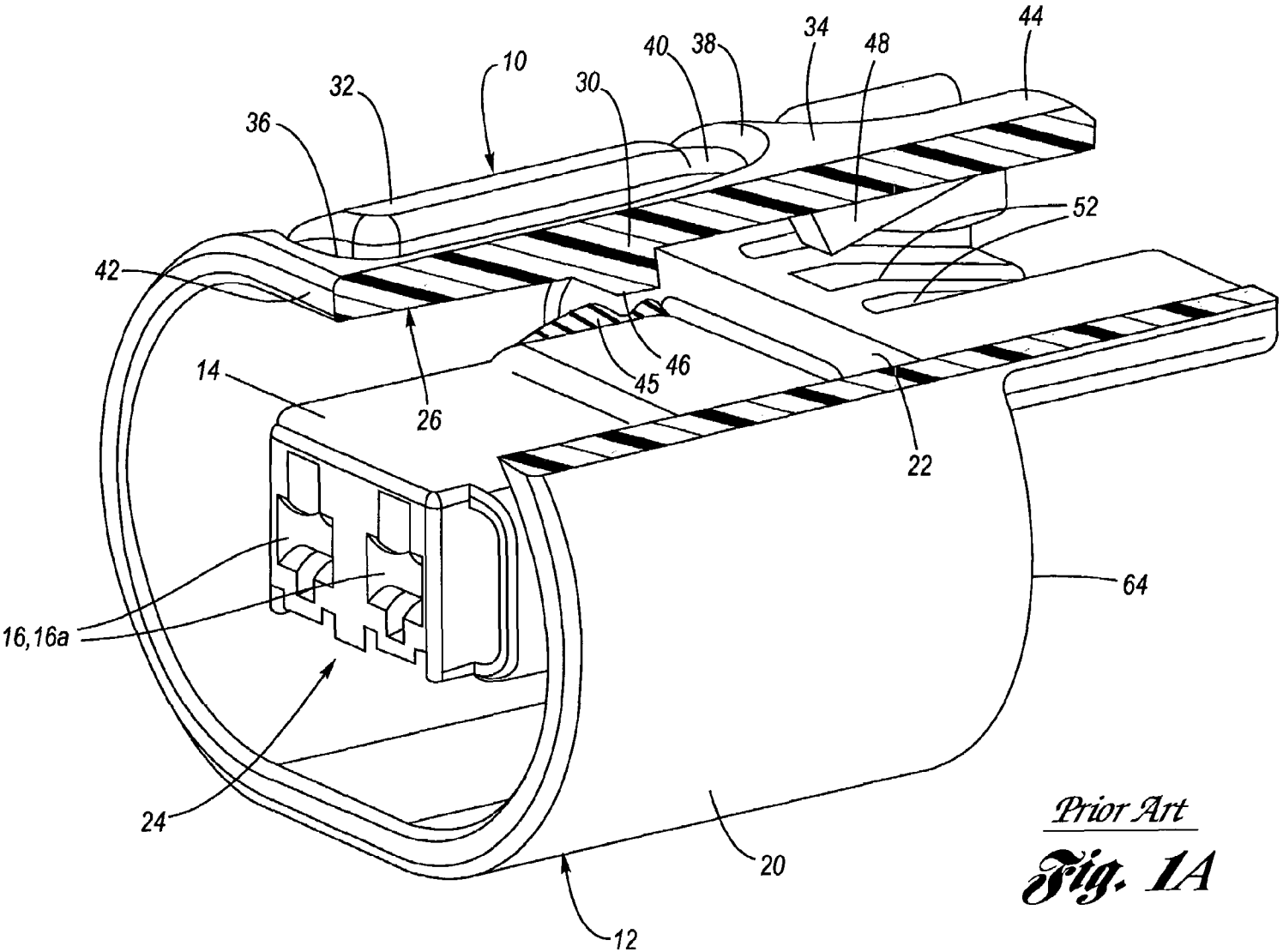
Prior Art Fig. 1A
FIG. 1A is a partly sectional, perspective front view of a prior art socket connector.
Figure 1B:
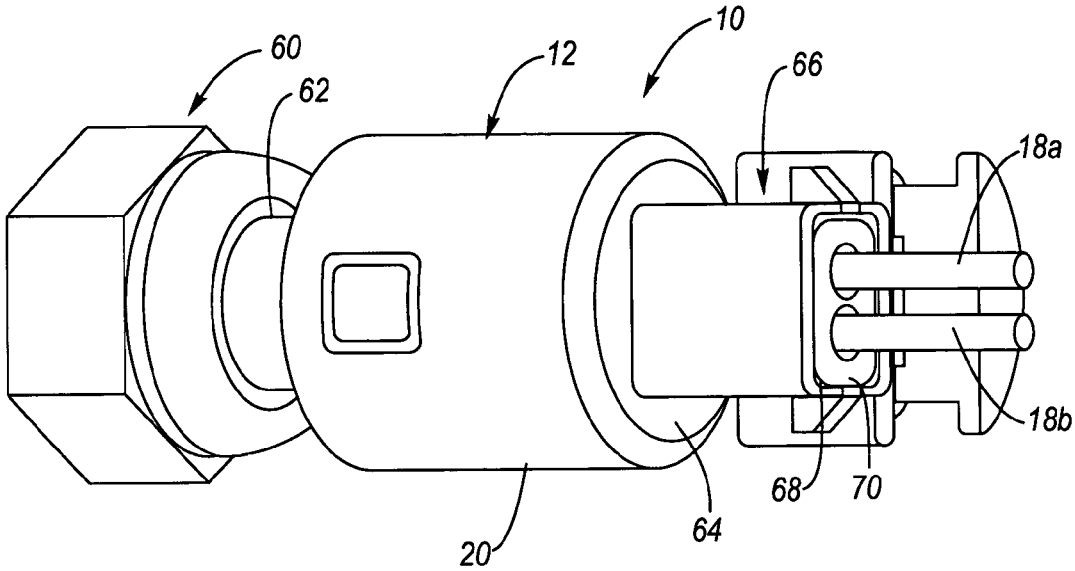
Prior Art Fig. 1B
FIG. 1B is a perspective rear view of a prior art socket connector shown in operation with a plug connector, wherein the strain relief has not yet been snappingly attached to a seal housing of the socket connector.
Figure 1C:
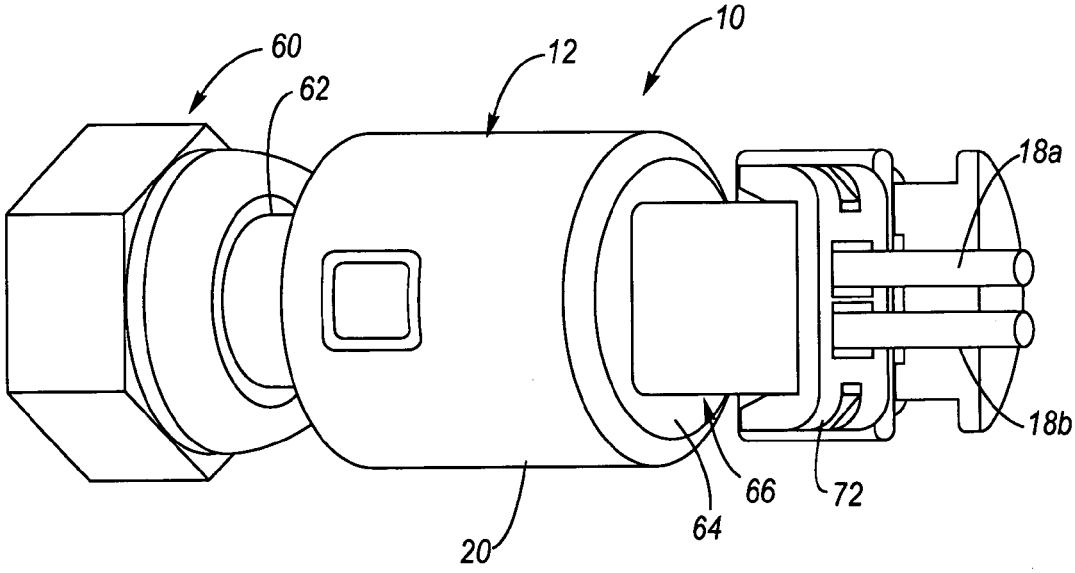
Prior Art Fig. 1C
FIG. 1C is a perspective view of the prior art socket connector of FIG. 1B, wherein now the strain relief has been snappingly attached to the seal housing.
Figure 2:
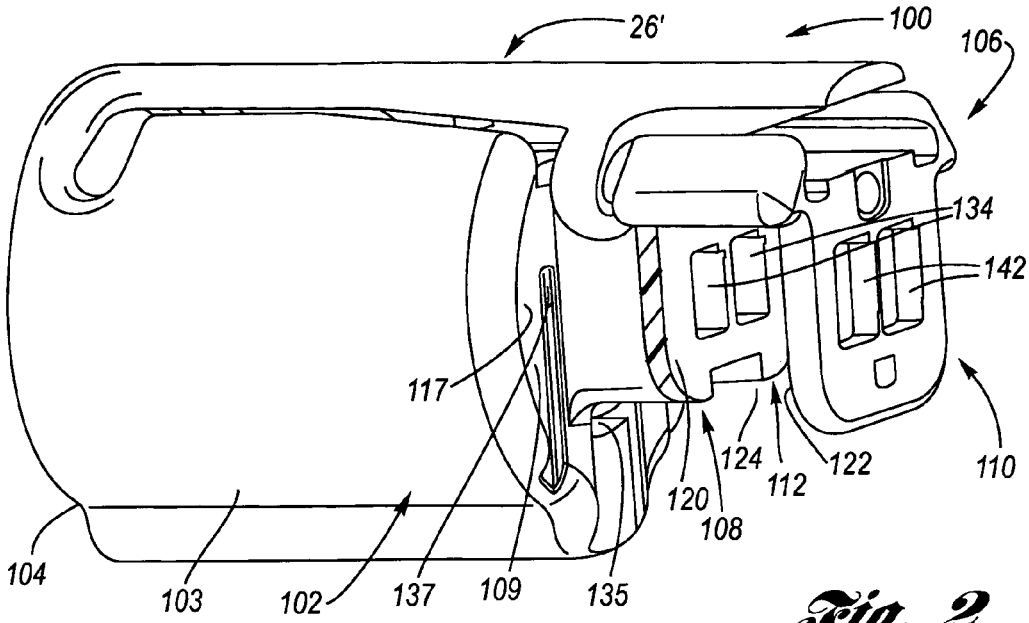
FIG. 2 is a perspective, rear view of a connector body of a socket connector according to the present invention which has been molded via a first molding operation of a co-mold process of the present invention, wherein the seal seat thereof is partly cut away.
Figure 2A:
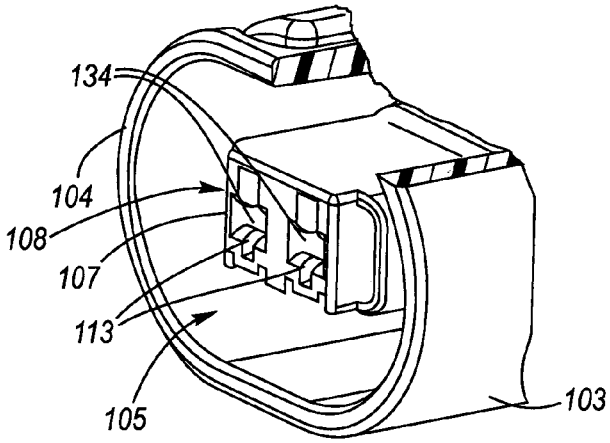
Figure 3:
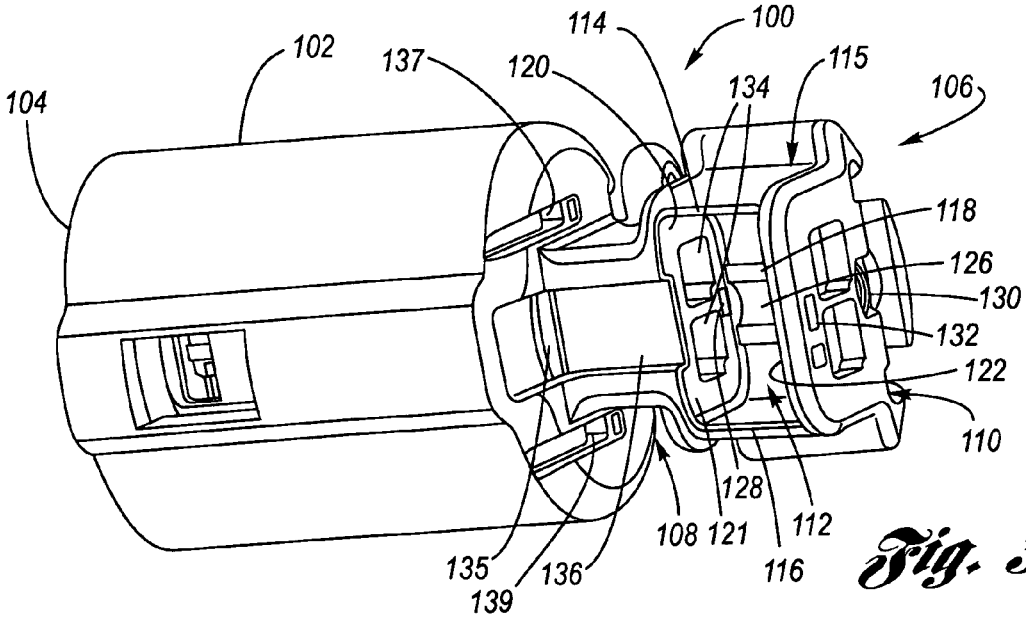
FIG. 3 is a second perspective, rear view of the connector body of FIG. 2, wherein the seal seat and the body and strain relief passages are visible.

Referring now to the Drawing, FIGS. 2 through 8B depict various aspects of a socket connector having a connector body co-molded with its peripheral and cable seals and the co-molding process therefor according to the present invention.

A socket connector 100 (shown at FIGS. 4 through 7) includes a connector body 102 which is preferably, but not necessarily, of the low profile socket connector type which includes a lock feature 26' as generally disclosed in above referenced U.S. Pat. No. 6,896,524.

The connector body 102 has a forward end 104 whereat is located a shroud 103 which defines a socket 105. Within the socket 105 is a forward end 107 of a terminal housing 108 which has at least one terminal cavity 134, each of which including a terminal seat 113.

The connector body 102 has a rearward end 109 disposed oppositely in relation to the forward end 104, wherein at the rearward end is a body end wall 117. Integrally connected to the body end wall 117 is a strain relief member 106 which includes a rearward end 121 of the terminal housing 108, a strain relief 110 and a seal seat 112.

The seal seat 112 is defined by a seal seat housing 115 composed of left and right sidewalls 114, 116 (shown fully at FIG. 3, but shown partly cut-away at FIG. 2) which extend between the terminal housing 108 and the strain relief 110, a top wall 118 which also extends between the terminal housing 108 and the strain relief 110, a terminal housing wall 120 which is oriented perpendicular to the left and right sidewalls and top wall, and a strain relief wall 122 which is oriented parallel to the terminal housing wall. The seal seat 112 has a bottom opening 124 disposed opposite in relation to the top wall 118 which extends between the terminal housing and the strain relief.

The top wall 118 has an optional concave notch 126 extending between the terminal housing and strain relief walls 120, 122. A first body passage 128 is provided in the terminal housing wall 120 adjoining the notch 126. An optional first strain relief passage 130 may be provided in the strain relief wall 122 adjoining the notch 126. An optional second strain relief passage 132 may be provided in the strain relief wall 122 adjacent the bottom opening 124. A slot 136 is provided in the terminal housing 108 adjacent the bottom opening 124. A main body passage 135 is provided in the body end wall adjoining the slot 136 which communicates between the seal seat 112 and the socket 105. On either side of the terminal housing 108 are, respectively, optional second and third body passages 137, 139 formed in the body end wall 117.

Figure 7:
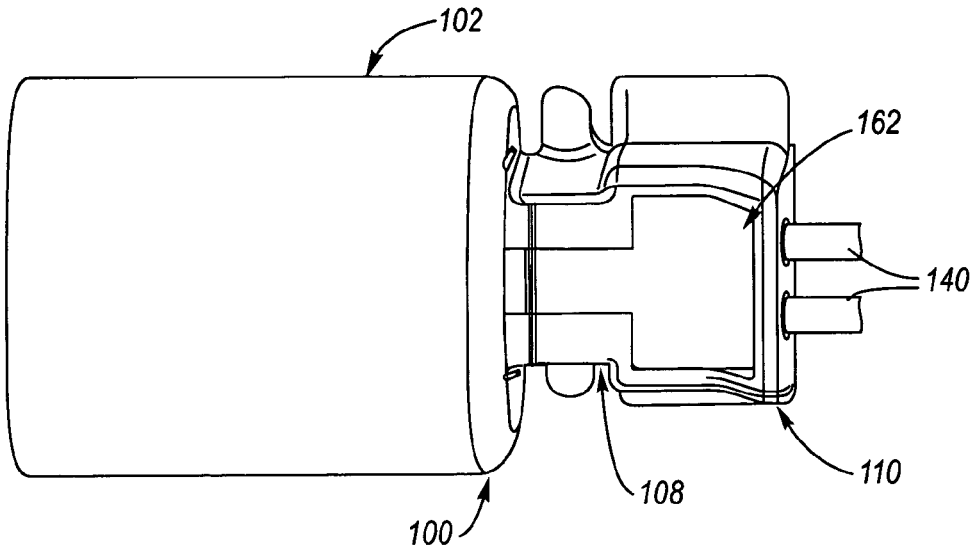
FIG. 7 is a perspective, rear view of a socket connector as shown at FIG. 4, wherein now cables (wires) have been operatively inserted and seated into respective terminal cavities of the socket connector.

The rearward end 121 of the terminal housing 108 has the above referenced at least one terminal cavity 134, commencing at the terminal housing wall 120, for receiving therein terminal provided cables (wires) 140 (see FIG. 7). The strain relief 110 and its associated strain relief wall 122 has at least one strain relief opening 142, one for each terminal cavity 134 and aligned respectively therewith.

Figure 4:
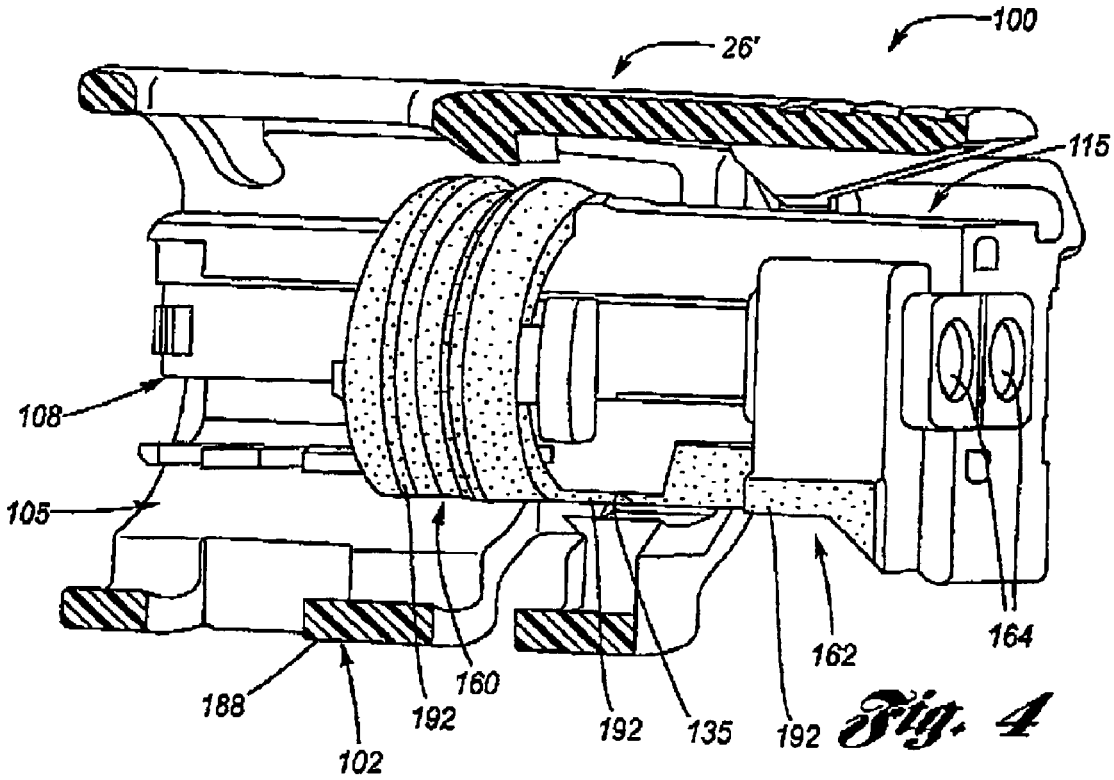
FIG. 4 is a perspective, cross-sectional view of a socket connector according to the present invention, including the connector body of FIG. 2, wherein now the peripheral and cable seals have been molded via a second molding operation of the co-mold process of the present invention.
Figure 5:
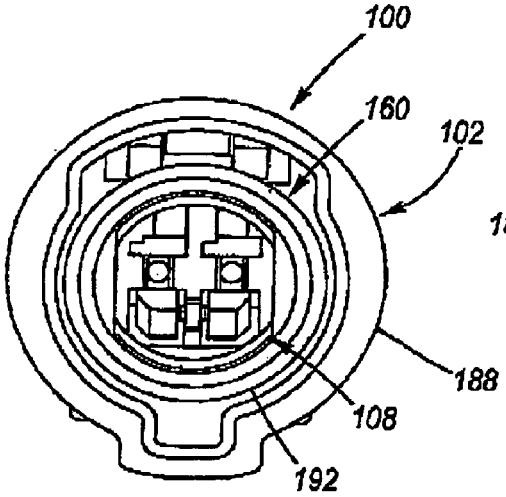
FIG. 5 is a forward end view of the socket connector of FIG. 4.
Figure 6:
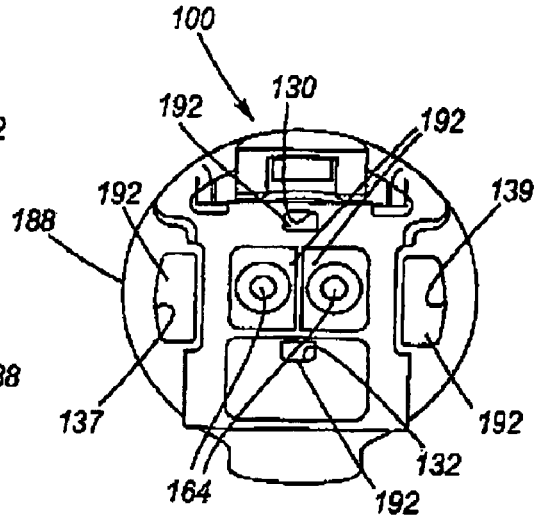
FIG. 6 is a rearward end view of the socket connector of FIG. 4.

Referring now additionally to FIGS. 4 through 6, a peripheral seal 160 is disposed within the socket 105 which peripherally engirds the forward end 107 of the terminal housing 108, and a cable seal 162 is disposed in the seal seat 112, wherein a seal opening 164 is respectively provided alignigly with each terminal cavity 134 and strain relief opening 142. The peripheral seal 160 and the cable seal 162 are composed of an elastomer, as for a preferable example a silicone rubber. In accordance with the co-mold process of the present invention, the peripheral seal 160 and the cable seal 162 are provided during a second molding operation after a first molding operation in which the connector body has been provided.

The co-mold process according to the present invention for providing the hereinabove socket connector 100 will now be detailed with particular reference to FIGS. 4 through 8B.

A multi-part mold 180 is provided having a molding cavity 182 and a sprue 184 communicating with the molding cavity.

Figure 8A:
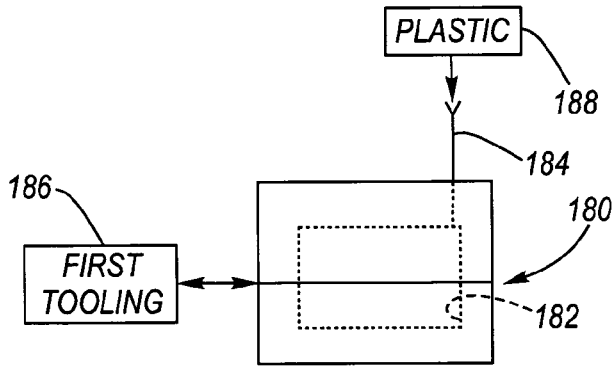
FIGS. 8A and 8B are schematic diagrams which sequentially depict the first and second molding operations of the co-mold process according to the present invention.

Referring now to FIG. 8A, in a first molding operation of the co-mold process, a first tooling 186 is placed into the molding cavity 182 of the mold 180. The first tooling 186 and the molding cavity 182 are cooperatively configured so that plastic 188 injected into the molding cavity via the sprue 184 forms the connector body 102 shown at FIGS. 2 through 3, which integrally includes the terminal housing 108 and strain relief member 110. The first tooling 186 is thereafter removed from the mold 180 and the plastic 188 is allowed to cool.

Figure 8B:
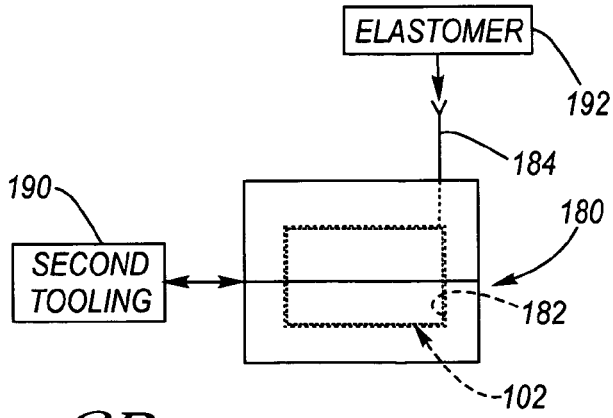

Referring now to FIG. 8B, in the second molding operation of the co-mold process, a second tooling 190 is placed into the molding cavity 182 of the mold 180. The second tooling 190, the connector body 102, and the molding cavity 182 are cooperatively configured so that elastomer (ie., silicone rubber) 192 injected into the molding cavity 182 via the sprue 184 passes into the bottom opening 124, filling the seal seat 112 to provide the cable seal 162, passing through the main body passage 135 to thereby provide the peripheral seal 160, wherein the cable seal and the peripheral seal are integrally connected through the main body passage (see FIG. 4), and wherein the elastomer fills the other body passages to thereby locatably retain the elastomer in the connector body 102. The elastomer also preferably has a chemical bond to the connector body. The second tooling 190 is thereafter removed from the mold 180.

After the co-mold process has been completed, the mold 180 is opened and the socket connector 100 removed therefrom. Thereupon, as shown at FIG. 7, terminals, which are located at respective ends of cables (wires) 140, are placed into the respective terminal cavities and seated at respective terminal seats of the forward end of the terminal housing by passing through respectively aligned strain relief and seal openings into the terminal cavity.

To those skilled in the art to which this invention appertains, the above described preferred embodiment may be subject to change or modification. Such change or modification can be carried out without departing from the scope of the invention, which is intended to be limited only by the scope of the appended claims.

The invention claimed is:

1. A socket connector, comprising:
- a connector body having a forward end and a rearward end, said connector body comprising:
- a strain relief member integrally connected to said rearward end of said connector body, a seal seat being located in said strain relief member;
- a shroud integrally connected with said forward end of said connector body, said shroud defining a socket; and
- a terminal housing having a forward end and a rearward end, said forward end of said terminal housing being disposed in said socket, said rearward end of said terminal housing being integrally connected with said strain relief member;
- a cable seal disposed in said seal seat; and
- a peripheral seal peripherally engirding said forward end of said terminal housing and disposed in said socket;
- wherein said connector body has at least one passage, said cable seal and said peripheral seal being integrally connected to each other through said at least one passage.

2. The socket connector of claim 1, wherein said seal seat is defined by a seal seat housing comprising;
- a left sidewall extending between said terminal housing and said strain relief;
- a right sidewall extending between said terminal housing and said strain relief;
- a top wall extending between said terminal housing and said strain relief;
- a terminal housing wall of said terminal housing, said terminal housing wall being oriented perpendicular in relation to said left sidewall, said right sidewall and said top wall; and
- a strain relief wall of said strain relief, said strain relief wall being oriented parallel to said terminal housing wall;
- wherein a bottom opening is formed between said terminal housing and said strain relief, said bottom opening being disposed opposite said top wall; and
- wherein said at least one passage comprises a main body passage formed in said connector body which communicates between said socket and said seal seat.

3. The socket connector of claim 1, further comprising a cable terminal of a inserted into one or more terminal cavity of the socket connector.

4. A socket connector, comprising:
- a connector body having a forward end and a rearward end that includes a seal seat, said connector body comprising:

a shroud associated with said forward end of said connector body, said shroud defining a socket; and a terminal housing having a forward end and a rearward end, said forward end of said terminal housing being disposed in said socket;

a cable seal disposed in said seal seat; and a peripheral seal peripherally engirding said forward end of said terminal housing and disposed in said socket;

wherein said connector body has at least one passage, said cable seal and said peripheral seal being connected to each other through said at least one passage.

5. The socket connector of claim 4, wherein said connector body further comprises a strain relief member that is connected to said rearward end of said connector body.

6. The socket connector of claim 4, wherein said seal seat is located in said strain relief member.

7. The socket connector of claim 4, wherein said shroud is integrally connected with said forward end of said connector body.

8. The socket connector of claim 4, wherein said rearward end of said terminal housing is integrally connected with said strain relief member.

9. The socket connector of claim 5, wherein said seal seat is defined by a seal seat housing comprising:

a left sidewall extending between said terminal housing and said strain relief;

a right sidewall extending between said terminal housing and said strain relief;

a top wall extending between said terminal housing and said strain relief;

a terminal housing wall of said terminal housing, said terminal housing wall being oriented perpendicular in relation to said left sidewall, said right sidewall and said top wall; and a strain relief wall of said strain relief, said stain relief wall being oriented parallel to said terminal housing wall;

wherein a bottom opening is formed between said terminal housing and said strain relief, said bottom opening being disposed opposite said top wall.

10. The socket connector of claim 9, wherein said at least one passage comprises a main body passage formed in said connector body which communicates between said socket and said seal seat.

11. The socket connector of claim 4, further comprising a cable terminal of a inserted into one or more terminal cavity of the socket connector.

* * * * *